US006455104B1

(12) United States Patent
Kirwan

(10) Patent No.: US 6,455,104 B1
(45) Date of Patent: Sep. 24, 2002

(54) PAINT DISPENSING DEVICE

(76) Inventor: Gerald Philip Kirwan, Delta House 198 Red Bank Road, Blackpool, Lancashire FY2 9ET (GB)

( * ) Notice: Subject to any disclaimer, the term of this patent is extended or adjusted under 35 U.S.C. 154(b) by 77 days.

(21) Appl. No.: 09/606,954

(22) Filed: Jun. 29, 2000

(30) Foreign Application Priority Data

Jun. 29, 1999 (GB) ..... 99 14995

(51) Int. Cl.[7] ..... B05D 7/22; B05D 1/02

(52) U.S. Cl. ..... 427/236; 118/317; 118/DIG. 10; 222/174

(58) Field of Search ..... 118/317, 306, 118/DIG. 10, 323; 222/174, 167; 427/236, 181, 421

(56) References Cited

U.S. PATENT DOCUMENTS 4,432,472 A * 2/1984 Lamm ..... 222/174
4,797,305 A 1/1989 Schleicher
5,368,202 A 11/1994 Smrt

* cited by examiner

*Primary Examiner*—Richard Crispino
*Assistant Examiner*—Yewebdar T Tadesse
(74) *Attorney, Agent, or Firm*—Michael Best & Friedrich LLP

(57) ABSTRACT

A golf cup paint sprayer 10 comprises a rotationally mounted handle 12 mounted above an elongate neck portion 14, which comprises inner and outer tube sections 16 and 18 respectively. A cage 20 for holding an aerosol can of paint 22 is secured to the inner tube section 16, such that rotation of the handle 12 causes rotation of the cage and aerosol 22 therein. A lever action of the handle 12 allows the aerosol 22 to be activated by means of a push rod 32 extending down the inner tube 16. The interior of a golf cup 24 can be painted with the aerosol spray 22 by depression and rotation of the handle 12.

17 Claims, 6 Drawing Sheets

PAINT DISPENSING DEVICE

This invention relates to a paint dispensing device and to a method of dispensing paint, particularly, but not limited to, a paint spraying device for a golf cup and a method of spraying paint into a golf cup.

An existing method of spraying paint into a golf cup comprises a person taking an aerosol can containing the paint and bending down to direct the paint into the hole to cover the interior of the golf cup, which golf cup forms the periphery of the golf hole.

Disadvantages arise with this type of method because paint is frequently sprayed on to the grass surrounding the golf hole, which paint must later be removed. Also, this method is particularly time consuming in that a person can only spray one side of the golf cup before having to move around the hole to spray the other side of the cup. This procedure is time consuming, given that golf cups often need to be sprayed every day or every few days.

It is an object of the present invention to address the abovementioned disadvantages.

It is also an object of the present invention to provide a golf cup spraying device which allows a person to spray paint into a golf cup without having to move around a golf cup.

According to one aspect of the present invention a spraying device for spraying material onto the interior of a recess comprises:

container receiving means for receiving a container of the material to be sprayed;

activation means for activating a discharge of material from a container held in the container receiving means;

turning means for the container receiving means, for turning the container receiving means relative to the interior of a recess to be sprayed; and recess locating means for locating the spraying device relative to a recess to be sprayed.

The recess may be a golf cup of a golf hole.

The material to be sprayed may be paint.

The recess locating means may include an abutment portion for abutting an area at least partially surrounding the edge of a recess to be sprayed. The abutment portion may be ring shaped. The abutment portion may be shaped to conform to the shape of a recess to be sprayed. Friction between the abutment portion and the area around a recess to be sprayed, may, in use, prevent relative movement of the abutment portion and the area around a recess.

The recess locating means may include a bridging section between the abutment portion and a first handle section.

The bridging section may be arranged to receive the container receiving means. The bridging section may form a cage around the container receiving means. The bridging section may allow access to the container receiving means.

The first handle section may be elongate, and/or may be tubular.

The turning means may include a second handle section and may include a neck portion. The second handle section and preferably the neck portion may be mounted for rotational movement relative to the first handle section. The neck section may be elongate and may be tubular. The neck section may be received in the first handle section. The neck section may extend through the entire length of the first handle section. In which case the second handle section may be located at an end of the neck section. The container receiving means may be located at an other end of the neck section.

The first and second handle sections may include low friction abutting sections to allow smooth relative movement of the two handle sections. The abutting sections may be disc shaped.

The second handle section may include a lever to allow a user to turn the second handle section relative to the first handle section.

The activation means may extend between the second handle section and the container receiving portion. The activation means may include an elongate neck, which may be a rod. The neck may be secured at one end to the second handle section of the turning means, preferably to the lever.

The rod may extend into the container receiving means. A stopper may be secured to the rod within the container receiving means. The stopper may be adapted to engage a container placed in the container receiving means.

The neck of the activation means may be actuable to be urged towards the container receiving means by the second handle section. Movement of the neck portion may, in use, cause the stopper to press against a container held in the container receiving means. The container receiving means may include an abutment surface against which a container may be pushed by the stopper.

The container receiving means may be adapted to receive an aerosol spray container, in which case pressure on the base thereof, causing the container to bear against the container receiving means, may activate discharge of material from the container.

The container receiving means may comprise a cage, bars of which may be spaced to receive a container therebetween, preferably in a snap fitting manner. The container receiving means may be adapted to receive an aerosol container in an inverted orientation.

The recess locating means may comprise height adjustment means for the container receiving means. The neck of the turning means may be received in the height adjustment means, the neck may extend through the height adjustment means. The height adjustment means may provide a resilient bias to generally downward movement of the neck of the turning means. The neck of the turning means may include an abutment member for abutment against a resilient bias of the height adjustment means.

The height adjustment means may function separately from the activation means. The height adjustment means may permit material to be sprayed at different levels of the recess to be sprayed.

According to another aspect of the present invention a method of spraying material into the interior of a recess comprises locating a spraying device over a recess to be sprayed with recess locating means of the device; activating a discharge of material from a container of said material held in container receiving means with activation means of the device; and turning the container receiving means of the device relative to the recess with turning means of the device.

All of the above aspect may be combined with any of the features disclosed herein, in any combination.

DESCRIPTION OF THE PREFERRED EMBODIMENTS

Specific embodiments of the present invention will now be described by way of example and with reference to the accompanying drawings, in which.

Figure 1:
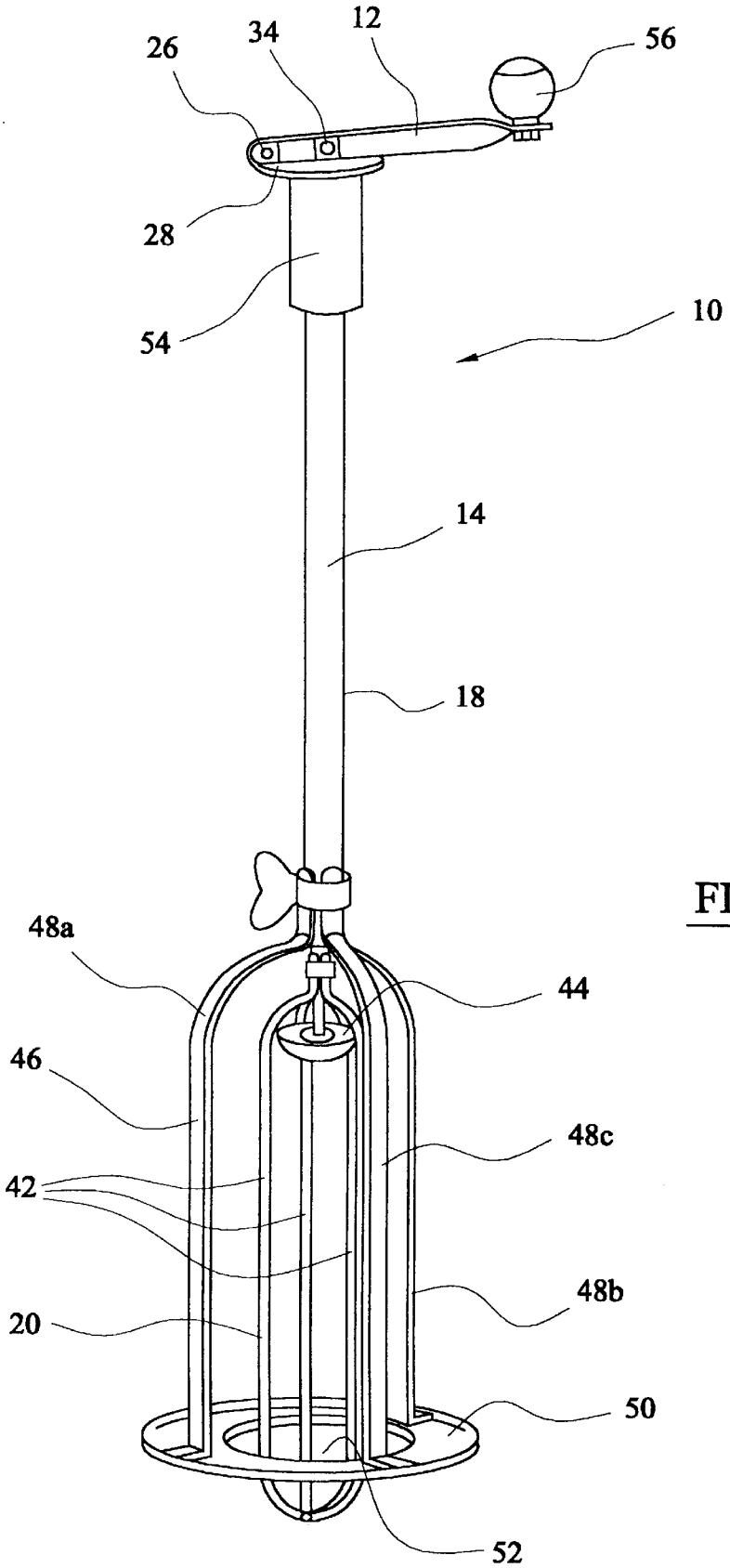
FIG. 1 is a schematic perspective view of a golf cup paint spraying device.
Figure 2:
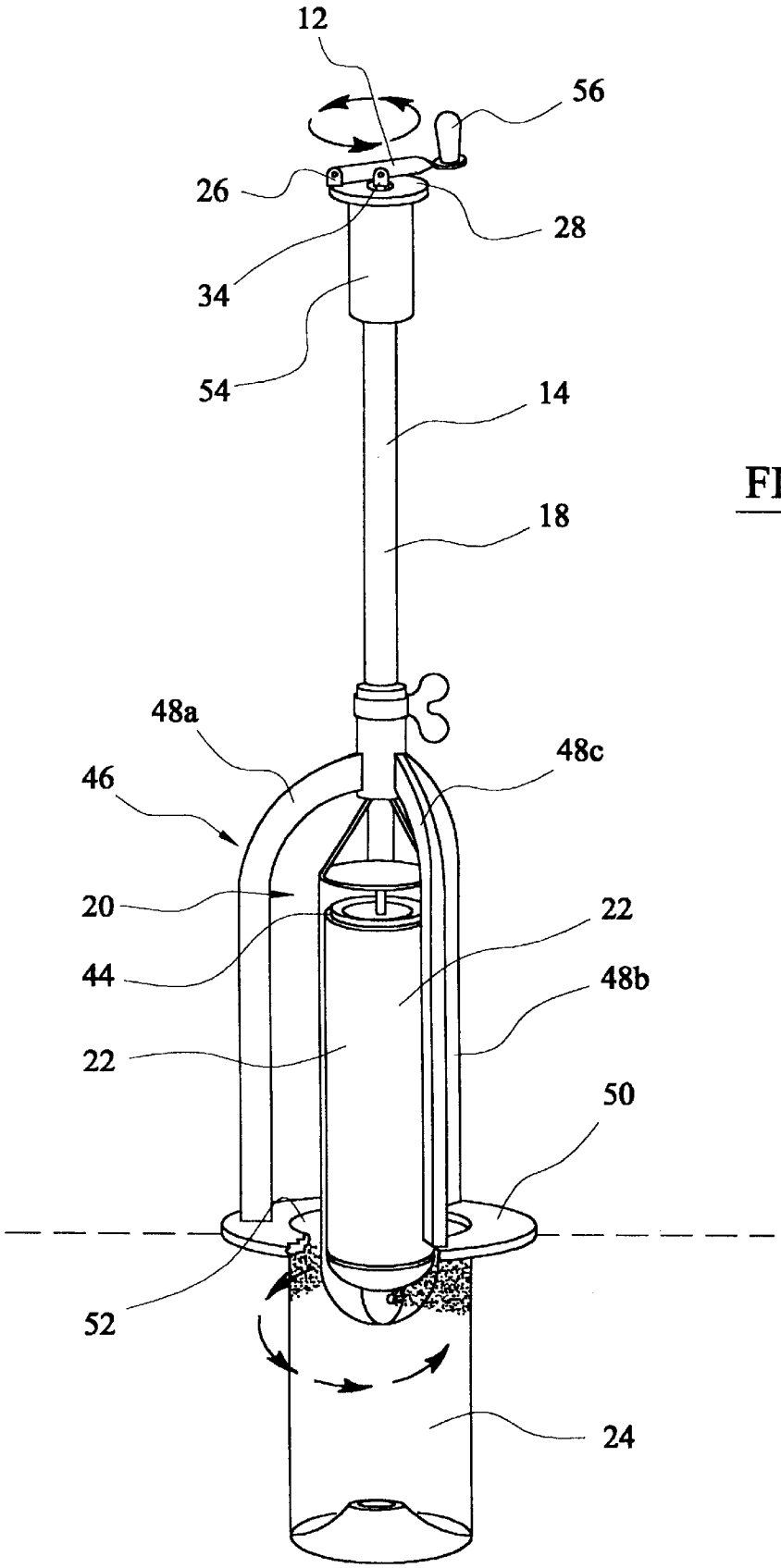
FIG. 2 is a schematic perspective view of the golf cup paint spraying device in use.

A golf cup paint sprayer 10 comprises a rotationally mounted handle 12 mounted above an elongate neck portion 14, which comprises inner and outer tube sections 16 and 18 respectively. A cage 20 for holding an aerosol can of paint 22 (see FIG. 2) is secured to the inner tube section 16, such that rotation of the handle 12 causes rotation of the cage and aerosol 22 therein. A lever action of the handle 12 allows the aerosol 22 to be activated by means of a push rod 32 extending down the inner tube 16. The interior of a golf cup 24 (see FIG. 2) can be painted with the aerosol spray 22 by depression and rotation of the handle 12.

Figure 5:
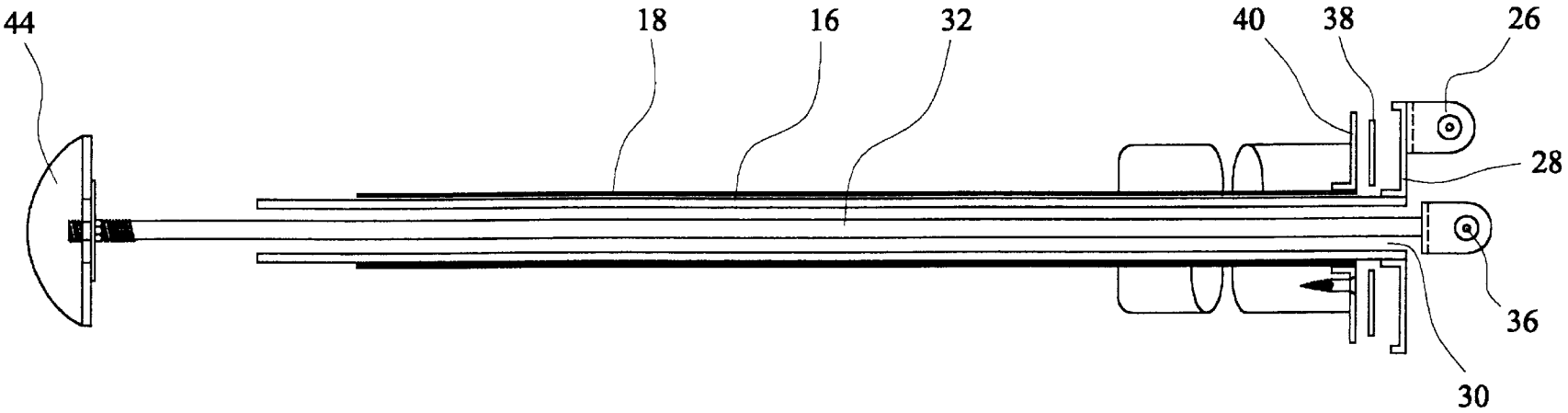
FIG. 5 is a partial schematic cross-sectional view of a shaft and handle portion of the first embodiment of golf cup paint spraying device.

In more detail, the handle 12 is pivotally mounted on a bracket 26 at the edge of a disc 28. A central opening 30 (see FIG. 5) in the disc 28 receives the rod 32, which extends from the disc 28 down through the centre of the inner tube section 16. A bracket 34 on an upper end of the rod 32 is secured approximately mid way along the handle 12. The bracket 34 includes a pivoting section 36 to allow for relative pivoting between the handle 12 and the rod 32.

The disc 28 is secured to an upper end of the inner tube section 16.

The inner tube section 16 has a close fit with the outer tube 18, through the centre of which the inner tube section 16 extends.

The inner tube section 16 is able to rotate freely within the outer tube section 18. The relative rotation is aided by a washer 38 which is received between the disc 28 of the inner tube section 16 and a second disc with a central opening 40 which is secured to an upper end of the outer tube section 18. The first disc 28, washer 38 and second disc 40 are all made of plastics material with surfaces having low friction to allow for relative rotation between the first and second discs 28 and 40.

The cage 20 is secured to a lower end of the inner tube section 16, where that section protrudes from the lower end of the outer tube section 18.

The cage 20 consists of three bars which form an elongate cage in which an aerosol can 22 is to be received. The bars 42 of the cage are not evenly spaced (see FIG. 6), there being an opening between two of the bars which allows for a standard size of aerosol can to be pushed between those two bars 42 and received in the cage 20 in a snap fitting manner. The cage 20 is arranged to receive the aerosol can 22 with the dispensing end of the aerosol at the lowest part of the cage 20, meaning that the aerosol can 22 is inverted compared to normal use.

The rod 32 protrudes into the cage 20 from the inner tube section 16. At the base of the rod 32 there is secured a rubber stopper which is received in the concave base of the aerosol can 22. The length of the rod 32 is chosen so that depression of the lever 12 causes the stopper 44 to be pushed downwards thereby causing the spraying section of the aerosol 22 to be depressed against the base of the cage leading to paint being sprayed from the aerosol can 22. When the lever 12 is raised the flow of paint ceases.

An outer cage 46 is secured to a lower end of the outer tube section 18. The outer cage comprises three evenly spaced bars 48*a, b* and *c*. The outer cage 46 comprises a base section 50 which has a central opening 52 which is larger than the width of the cage 20. The cage 20 projects down below the level of the base section 50. The base section 50 covers the ground surrounding the golf cup to prevent paint being sprayed inadvertently onto the ground.

In use, an aerosol can 22 is pushed in to the cage 20 in an inverted orientation. A user then places the base section 50 over a golf hole so that the cage 20 projects slightly in to the hole. The user then presses down on the lever 12 which causes the rod 32 and the stopper 44 to compress the aerosol can 22, thereby causing paint to be sprayed from the aerosol. The aerosol directs paint on to the golf cup 24. In order to obtain an even covering of paint around the interior of the golf cup 24 the user rotates the handle 12 about the rod 32. The rotation is achieved by the inner tube section 16 turning relative to the outer tube section 18. When the user has made one or two complete rotations of the handle 12, which ever is desired, the handle 12 is lifted to cease the flow of paint from the aerosol 22 and the paint sprayer 10 can be lifted from the golf hole and the painting of the golf cup 24 is complete.

The base 50 is pushed against the ground which causes friction to allow the outer tube 18 attached to the base to remain stationary whilst the inner tube 16 and cage 20 are rotated.

The paint sprayer also includes a wooden handle 54 by which the user can grasp the device. Also, a suitably shaped knob 56 is located on the end of the handle 12 to make the handle easier to hold.

Figure 3:
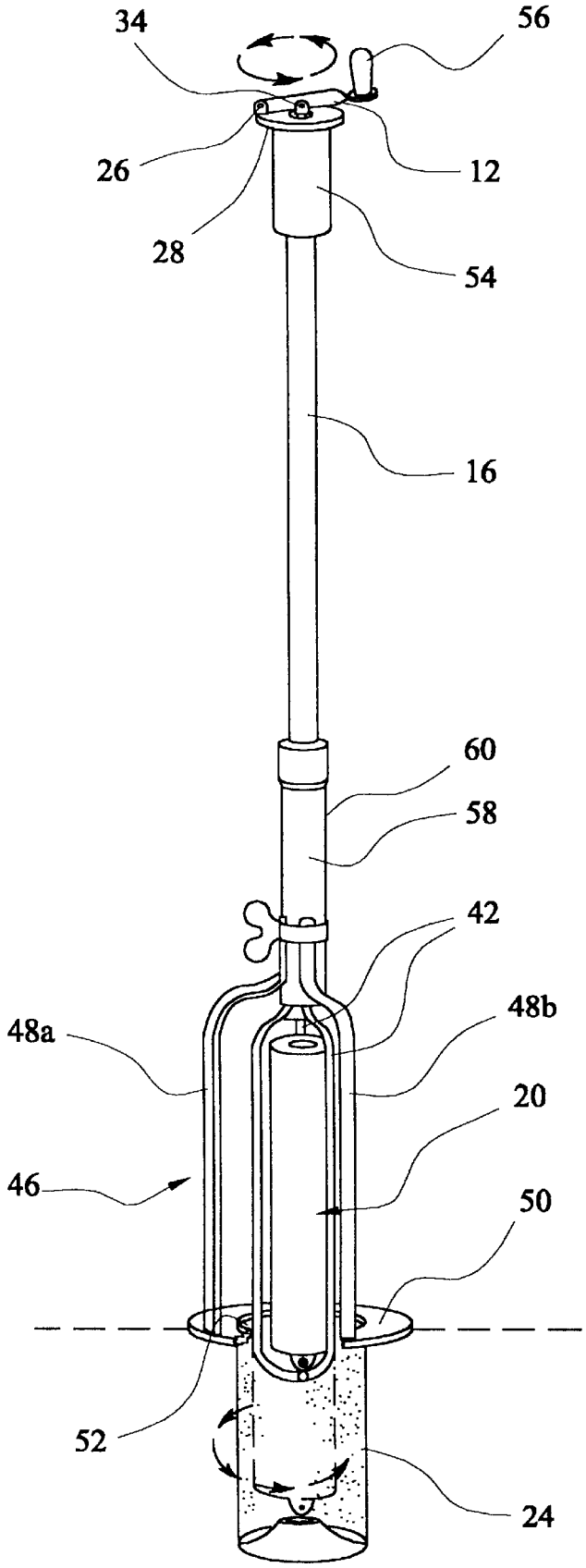
FIG. 3 is a schematic perspective view of a second embodiment of golf cup paint spraying device in use with a plunger unit attached.
Figure 4:
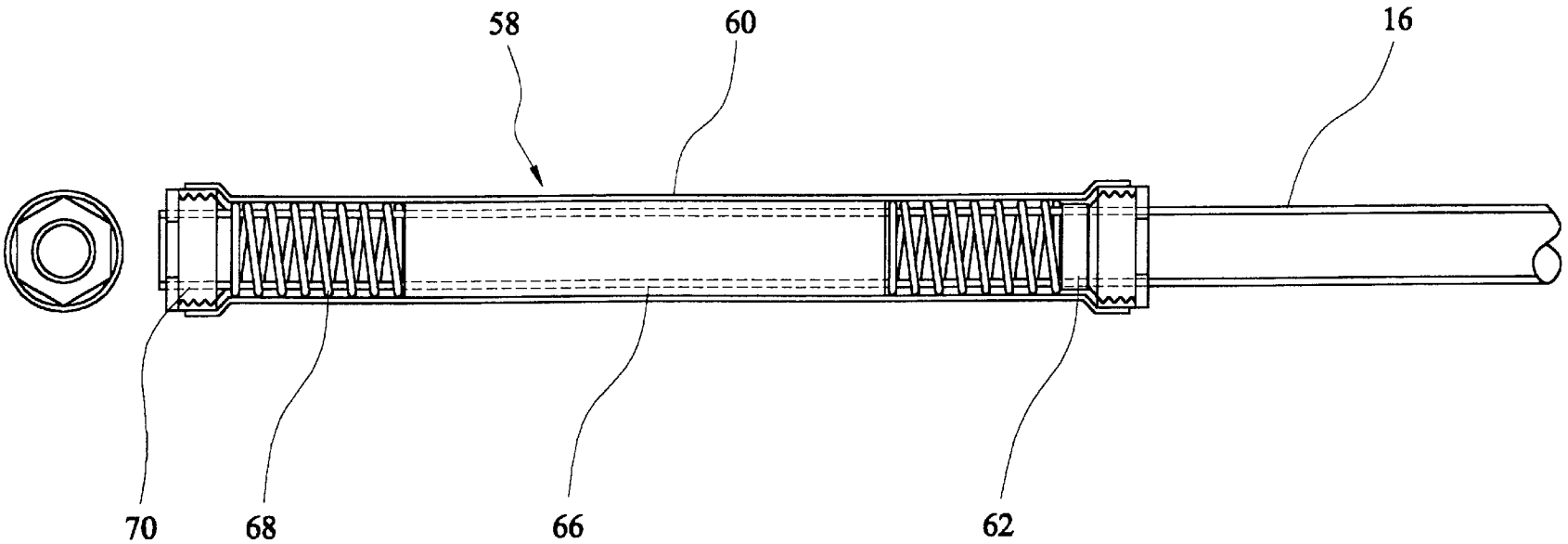
FIG. 4 is a schematic cross-sectional view of the plunger unit shown in the second embodiment in FIG. 3.

A further embodiment of golf cup paint sprayer 10 is shown in FIGS. 3 and 4. The second embodiment has many features in common with the first embodiment and like features are given like references.

The second embodiment differs in comprising a plunger unit 58, which allows the cage 20 to be moved up and down to a small amount to facilitate painting of a greater area of the golf cup 24.

The plunger unit 58 comprises an outer tube 60 which corresponds to a lower section of the outer tube 18 of the first embodiment. The inner tube section 16 extends through the plunger 58. The inner tube section 16 is modified by the addition of a soldered abutment 62 close to the top of the plunger unit 58. The abutment 62 bears against a coiled spring 64 which is located around the inner tube section 16. The spring 64 bears against a spacer section 66, which comprises a section of plastic tube received between the outer tube 60 and the inner tube section 16. A second spring 68 bears against one end of the spacer 66 and an end piece 70 of the plunger 58.

The plunger 58 allows the inner tube section 16 to be moved up and down against the pressure of the springs 64 and 68 allowing the cage 20 to move up and down also to give a larger area over which the aerosol can 22 can be used to spray paint.

Above the plunger 58 and below the base of the wooden handle 54 is it not necessary to have a section of the outer tube 18. Relative movement between the outer 18 located within the wooden handle 54 and the inner tube section 16 can be effected as described above in relation the first embodiment.

Figure 6:
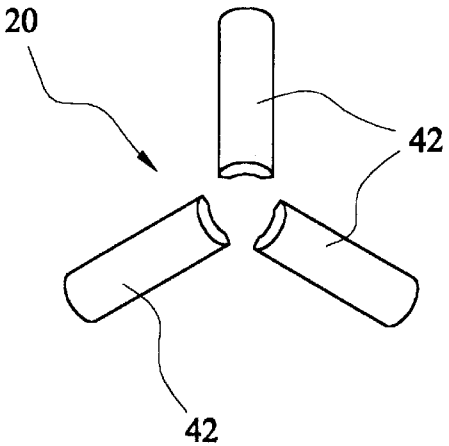
FIG. 6 is a schematic view from below of a container-receiving cage for both embodiments.
Figure 7:
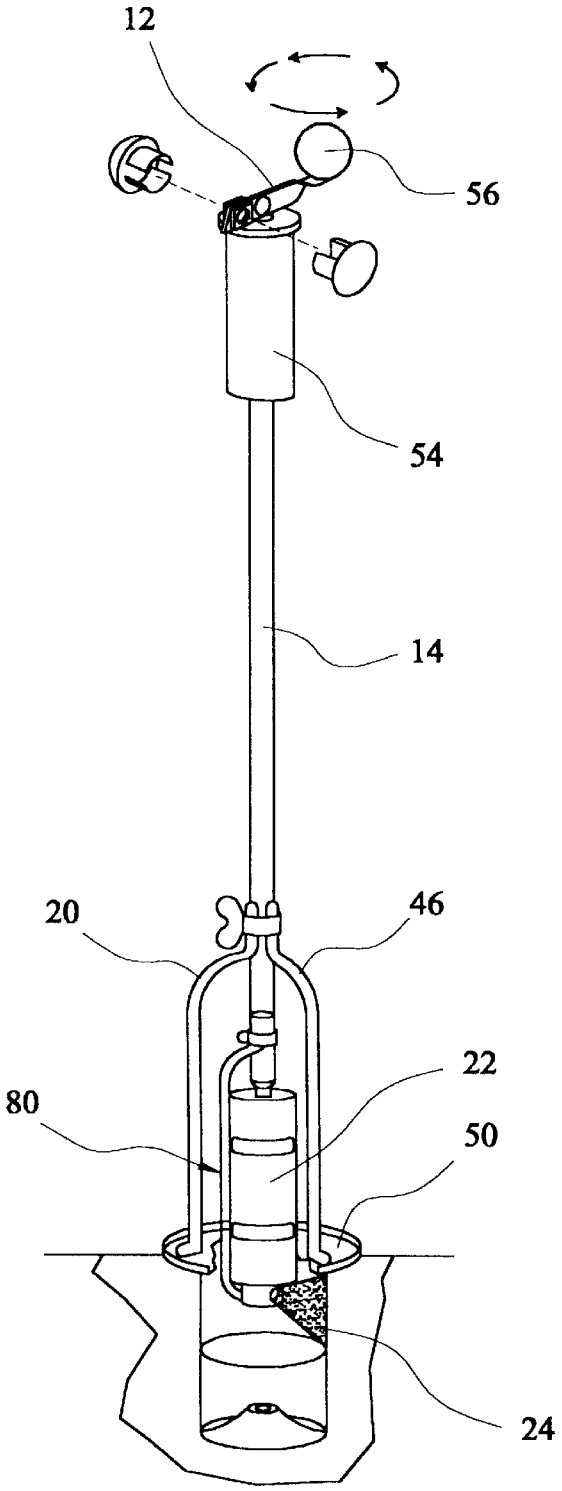
FIG. 7 is a schematic view of a third embodiment of golf cup paint spraying device.
Figure 8:
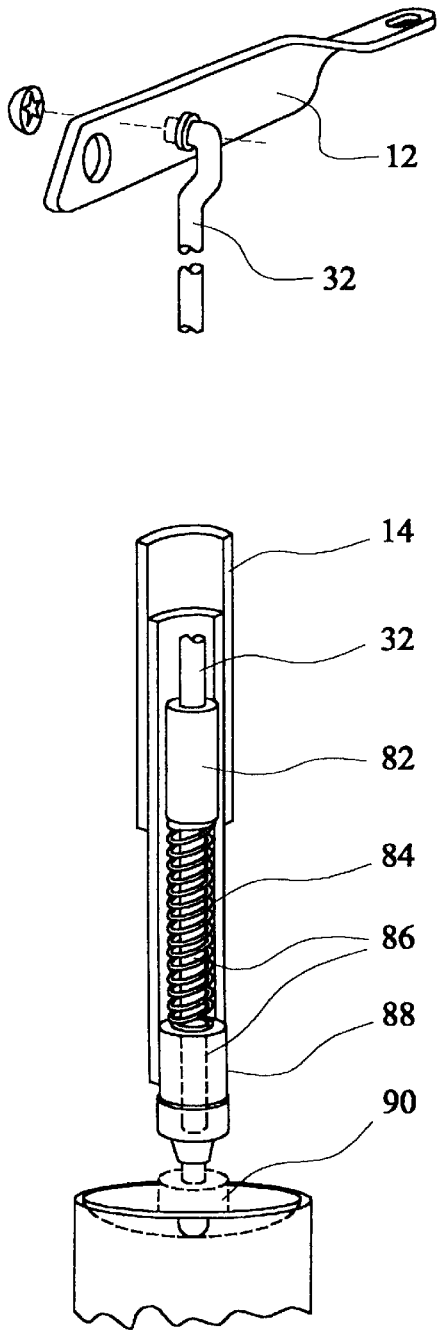
FIG. 8 is an enlarged partial view of the third embodiment.

FIGS. 6 and 7 show a third embodiment of golf cup paint sprayer. Like parts to the previous embodiments have been given like numerals.

The third embodiment differs in that the aerosol can 22 is held in a bracket 80, one end of which holds the spraying end of the can 22 and another end of which is secured to the outer tube 18.

As shown in FIG. 7 the push rod 32 is secured to an upper bush fixing 82 below which is a compression spring 84 around a rod 86. At the lower end of the rod 86 and spring 84 is a lower fixed bush 88 which has a lower projection 90 extending from the bottom thereof. The lower projection 90 engages the base of the aerosol can 22.

In use, when the lever 12 is depressed, the push rod 32 causes the projection 90 to push the base of the aerosol can 32 causing paint to spray therefrom. Excessive movement of the lever 12 is taken up by the upper bush fixing 82 which slides on the rod 86. This feature reduces excessive pressure, which would otherwise be exerted on the aerosol can, and may have lead to unnecessary damage to the aerosol can 22. Also, less reliance is made on the aerosol can spring mechanism for closing the supply of paint, because pressure is taken up by the spring 84.

The golf cup paint sprayer disclosed herein enables a user to rapidly and effectively paint the inner face of a golf cup, in a single action. This ability gives significant advantages over previous methods.

The provision of a snap fitting cage for receiving the aerosol can 22 is also advantageous in that the paint supply can easily be replaced.

The paint spraying device disclosed herein can also be used for spraying other materials in to the interior of a recess with no alterations to the device described above.

The paint spraying device disclosed herein could be altered to receive an aerosol can in an upright orientation, which would then permit the device to be used to paint the interior of a recess in a ceiling for instance or other downward facing surface.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extend to any novel one, or any novel combination, of the features disclosed in this specification (including any accompanying claims, abstract and drawings), or to any novel one, or any novel combination, of the steps of any method or process so disclosed.

What is claimed is:

1. A spraying device for spraying material onto the interior of a recess comprises:

container receiving means for receiving a container of the material to be sprayed;

activation means for activating a discharge of material from a container held in the container receiving means;

turning means for the container receiving means for turning the container receiving means relative to the interior of a recess to be sprayed; and recess locating means for locating the spraying device relative to a recess to be sprayed.

2. A spraying device as claimed in claim 1, in which the recess is a golf cup of a golf hole.

3. A spraying device as claimed in claim 1, in which the material to be sprayed is paint.

4. A spraying device as claimed in claim 1, in which the recess locating means include an abutment portion for abutting an area at least partially surrounding the edge of a recess to be sprayed.

5. A spraying device as claimed in claim 4, in which friction between the abutment portion and the area around a recess to be sprayed, in use prevents relative movement of the abutment portion and the area around a recess.

6. A spraying device as claimed in claim 1, in which the recess locating means include a bridging section between the abutment portion and a first handle section.

7. A spraying device as claimed in claim 1, in which the turning means include a second handle section and a neck portion.

8. A spraying device as claimed in claim 7, in which the second handle section and the neck portion are mounted for rotational movement relative to the first handle section.

9. A spraying device as claimed in claim 7, in which the neck section is received in the first handle section.

10. A spraying device as claimed in claim 7, in which the second handle section includes a lever to allow a user to turn the second handle section relative to the first handle section.

11. A spraying device as claimed in claim 7, in which the activation means extend between the second handle and the container receiving portion.

12. A spraying device as claimed in claim 7, in which the activation means include an elongate neck, which neck is secured at one end to the second handle of the turning means.

13. A spraying device as claimed in claim 12, in which the neck of the activating means is actuable to be urged towards the container receiving means by the second handle section.

14. A spraying device as claimed in claim 1, in which the container receiving means is adapted to receive an aerosol spray container, and in which pressure on the base of the aerosol spray container, causing the container to bear against the container receiving means, activates discharge of material from the container.

15. A spraying device as claimed in claim 1, in which the container receiving means comprises a cage, bars of which are spaced to receive a container therebetween.

16. A spraying device as claimed in claim 1, in which the recess locating means comprise height adjustment means for the container receiving means.

17. A method of spraying material into the interior of a recess comprises locating a spraying device over a recess to be sprayed with recess locating means of the device; activating a discharge of material from a container of said material held in the container receiving means with activation means of the device; and turning the container receiving means of the device relative to the recess with turning means of the device.

* * * * *